United States Patent [19]

Osteen

[11] Patent Number: 4,505,089

[45] Date of Patent: Mar. 19, 1985

[54] CARRIER APPLICATOR

[75] Inventor: John F. Osteen, Lynchburg, Va.

[73] Assignee: DACAM Corporation, Madison Heights, Va.

[21] Appl. No.: 357,255

[22] Filed: Mar. 11, 1982

[51] Int. Cl.[3] ..... B65B 27/04; B65B 21/00

[52] U.S. Cl. ..... 53/48

[58] Field of Search ..... 53/48, 314, 315, 313, 53/367

[56] References Cited

U.S. PATENT DOCUMENTS

| | | | |
|---|---|---|---|
| 2,936,558 | 5/1960 | Glazer | 53/48 X |
| 3,070,928 | 1/1963 | Ganz | 53/48 |
| 3,302,364 | 2/1967 | Rice | 53/48 X |
| 3,680,279 | 8/1972 | Picq | 53/48 X |
| 4,231,209 | 11/1980 | Walker et al. | 53/48 |
| 4,392,586 | 7/1983 | Hartness et al. | 53/48 X |

*Primary Examiner*—Horace M. Culver
*Attorney, Agent, or Firm*—James & Franklin

[57] ABSTRACT

A plastic carrier is deposited on a set of bottles which are moved beneath a reciprocating platen. The platen carries a set of long fingers and a set of short fingers. Each long finger is positioned to align with a different one of the lower peripheral surface sections of the carrier. Each short finger is aligned with the upper surface of the carrier, which has a bottle engaging opening for each bottle. Between the upper and lower surfaces of the carrier is an inclined side surface. As the platen is moved downwardly, the long fingers first engage and cooperate with the inclined side surface to correct any misalignment between the carrier and the bottles. Further movement causes the long fingers to contact the peripheral surface sections, respectively, and the short fingers to contact the upper surface, seating the carrier.

16 Claims, 12 Drawing Figures

FIG. 10A
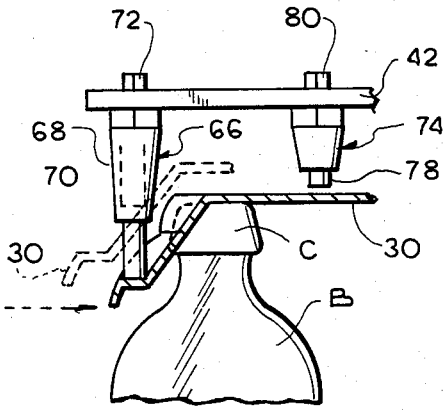
FIG. 9A
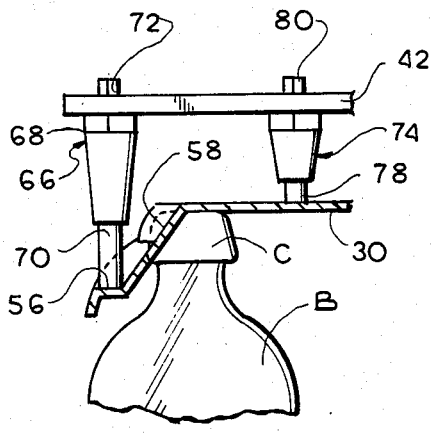
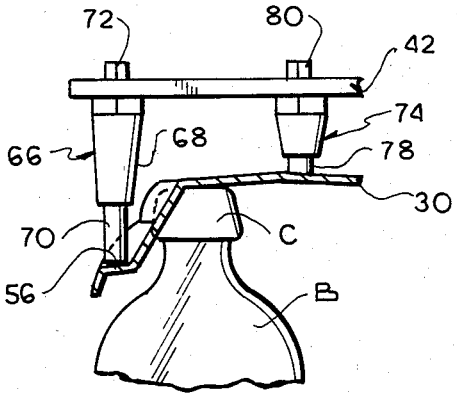
FIG. 10B
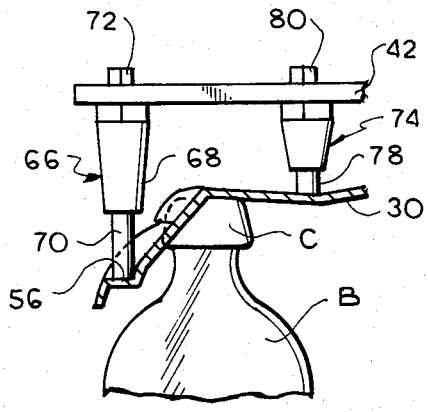
FIG. 9B

CARRIER APPLICATOR

The present invention relates to high speed automated equipment for applying plastic carriers to sets of containers and, more particularly, to the structure of a platen for use therein which corrects any misalignment of the carriers and insures proper seating of the carrier, while minimizing damage to the containers, carrier or closures.

Liquid containers, such as glass or plastic bottles and jars, in which carbonated beverages, juices, fruit drinks and the like are packaged, are often sold in multiples as a unit containing six or eight containers each. In order to maintain the containers as a unit and to protect the containers from damage and dirt during shipping, as well as to provide a convenient way to handle the containers, a carrier is often provided for the containers. The carriers have, in the past, commonly been formed of a paper product, such as cardboard, but, more recently, carriers composed of molded or extruded plastic materials have been utilized because plastic carriers are inexpensive, as well as being relatively high in strength and low in weight.

The structure of various types of plastic carriers designed to accommodate multiple containers are known in the art. One well known example is the Contour Pak carrier produced by Owens-Illinois. Such carriers commonly consist of a one-piece thermally formed plastic receptacle designed to enclose and engage the upper portion of each of the containers. The carriers are designed with a number of spaced compartments, each of which is contoured in accordance with the upper portion of the container. Each container is engaged by and suspended from an opening in a compartment in a "snap-fit" fashion by seating a plurality of flexible projections, extending inwardly from the opening, below an annular protrusion or flange on the neck of the container.

In some types of containers, the annular protrusion or flange is positioned on the neck of the container, immediately below the area upon which the container closure is situated. In other types of containers, the closure extends over the annular projection or flange and has an inwardly directed bottom sealing portion which extends over the annular projection or flange. This sealing portion is broken away when the closure is twisted off the container. In either case, the container is provided with an annular projection or flange (which may or may not be covered by the closure) which has a diameter greater than the section of the neck of the container immediately below same.

The carrier itself has a two level or tier structure. The upper level includes a substantially planar central surface which has a curved periphery defining the tops of the container receiving compartments. The top of each compartment is provided with a bottle engaging opening which extends through the upper surface of the carrier. The upper surface is also preferably provided with a pair of spaced finger-grip openings, such that the carrier can be conveniently grasped and held.

The lower level or tier of the carrier includes a number of substantially coplanar surface sections spaced from each other and distributed around the periphery of the carrier. The interior edge of each lower surface section is curved to follow the contour of the adjacent compartments. The exterior edge is normally straight to align with the lower skirt of the carrier.

Between the upper surface and the lower surface sections is an at least partially inclined or beveled side surface which defines the sides of the compartments. The side surface is continuous, extends around the carrier, and is contoured to accommodate the structural features of the containers.

Each of the container engaging openings in the upper surface of the carrier is provided with a set of diametrically opposed, inwardly extending projections which are preferably formed integrally with the carrier. The projections are, to some extent, flexible. As the top of the container is inserted through the opening, the container flange will cause the projections to cam out of the way. When the container is fully inserted, the projections return to their original positions and lodge below the container flange so as to engage the container and secure same to the carrier. To insure that the containers will not accidentally dislodge from the carrier, it is necessary that all of the projections associated with each opening be correctly positioned below the respective container flanges.

To be commercially successful, a carrier applicator must be fully automated and capable of high speed operation. In addition, the carrier applicator must operate in a way which minimizes the possibility of damage to the carrier, container, and closures.

A variety of different designs have been used in automated carrier applicators to achieve these ends. In Owens-Illinois Model 104-200 carrier applicator, several pairs of containers are moved along a first conveyor, as a carrier is dispensed from a second conveyor and deposited on top of the containers. Each container pair, with the carrier situated thereon, is moved, in turn, to a position between a pair of star wheels, below a rotatable cylinder which has pairs of spaced recesses situated along the surface thereof. Each pair of recesses on the cylinder surface is spaced from each adjacent pair of recesses by a distance which causes the recess pairs to align with the pairs of openings on the carrier as the cylinder is rotated and the carrier moved. As the cylinder rotates, each pair of protruding container tops is received, in turn, within the recess on the cylinder surface, and the surface of the cylinder exerts a downwardly directed force along the upper surface of the carrier so as to seat the container engaging projections below the container flanges.

This machine, however, has a number of important functional problems. It appears to perform satisfactorily with respect to the container engaging projections extending from the middle of the carrier upper surface because there is sufficient area on the upper surface of the carrier adjacent these projections to permit substantial contact between the surface of the cylinder and the upper surface of the carrier. However, the same is not true with respect to the projections extending from the outer periphery of the upper surface of the carrier because there exists in these areas only a very narrow shoulder, partially obstructed from above by the outwardly projecting container flange, upon which the downwardly directed forces can be applied. Since the diameters of the recesses must be larger than the diameters of the container flanges, all of the container engaging projections may not be correctly positioned with respect to the container flange. When this occurs, the containers can become dislodged from the carrier during shipping and handling, thereby negating the advantages of the use of a carrier.

In addition, in this machine, proper alignment of the containers with respect to each other, in the group, and individually with respect to the container engaging openings in the carrier, is a problem. This problem is partially overcome by employing rotatable star wheels which are intended to position the containers in each pair relative to each other. However, if the carrier openings are not properly aligned with the container pairs, or if the container parts are not properly aligned with the recesses in the cylinder, the carrier closure and/or container is damaged by the forced exerted by the rotating cylinder.

One method of overcoming the problems associated with the afore-mentioned machine is described in detail in U.S. Pat. No. 4,287,699, issued Sept. 8, 1981 to Willian F. Hart, entitled "Carrier Applicator", and owned by the assignee herein. In the carrier applicator described in that patent, the containers are aligned in parts by oppositely situated star wheels and the applicator is applied to each pair of containers in sequence, in a manner very similar to the Owens-Illinois machine. However, that machine solves the problem of alignment between the containers, carrier openings, and cylinder apertures, and the problem of incomplete projection enagement by eliminating the rotating cylinder and substituting therefor spaced sets of upstanding rotatable discs which are situated to exert progressively increasing forces adjacent each opening on the carrier upper surface. The final set of discs are especially designed to contact the upper surface of the carrier along the shoulders adjacent the outside projections. These discs are concave and deformable, in accordance with the curvature of the containers, to insure sufficient contact between the disc rims and the narrow shoulders along the outer periphery of the carrier upper surface. In this manner, the container engaging projections adjacent to the shoulder are always properly seated.

The carrier applicator of the present invention incorporates an approach which is different in several respects from the methods employed by the machines described above. In the above machines, the carriers are not applied to all of the containers in a container set simultaneously. In the Owens-Illinois machine, the carrier is applied to one pair of containers in a set at a time by the cylinder. In the machine described in U.S. Pat. No. 4,287,699, the carrier is gradually applied to the pairs of containers as the container set travels beneath the sets of discs. Thus, in the previously described machines, a continuous flow process is utilized. In the machine of the present invention, carriers are applied to all containers in each set simultaneously.

As is described in detail below, the machine of the present invention utilizes a reciprocating platen to apply a carrier to all of the containers in a set simultaneously. Because the platen is vertically reciprocating, it is possible to apply the carriers to containers which have already been placed in shipping cases. The application of the carriers to containers situated in cases eliminates the problem of alignment of the containers with respect to each other because the cases are designed to retain the containers snuggly in the proper relative positions. There is, therefore, no longer a necessity to use rotating star wheels to provide alignement between the containers, thereby reducing the complexity of the apparatus.

It is, therefore, a prime object of the present invention to provide a carrier applicator designed for fully automatic, high-speed operation which insures proper seating of every carrier.

It is another object of the present invention to provide a carrier applicator wherein carriers are automatically properly aligned with respect to the containers during the application operation.

It is another object of the present invention to provide a carrier applicator wherein the quantity of force required to provide proper seating of the carrier is reduced by directing same on the lower peripheral surface sections of the carrier.

It is another object of the present invention to provide a carrier applicator wherein seating is facilitated by exerting forces on the carrier in a manner which permits maximum flexing of the container engaging projections.

It is another object of the present invention to provide a carrier applicator wherein closure damage is minimized by exerting forces on the carrier at points thereon which are remote from the container engaging openings.

It is another object of the present invention to provide a carrier applicator wherein damage to the carriers during application is minimized.

It is another object of the present invention to provide a carrier applicator wherein container breakage is minimized.

It is another object of the present invention to provide a carrier applicator which is capable of applying carriers to containers situated in a packing case.

It is another object of the present invention to provide a carrier applicator which is composed of relatively simple, inexpensive parts which cooperate together reliably and which will function over an extended useful life with minimum maintenance.

In accordance with the present invention, apparatus is provided for applying a carrier to a set of containers. The carrier is of the type having a substantially planar first surface with container engaging openings therein. A plurality of peripheral second surface sections are present at a level spaced from the level of the first surface. The carrier also includes an at least partially inclined side surface, extending between the first surface and each of the second surface sections. The apparatus comprises a platent, means for supporting a set of containers with a carrier situated thereon and means for moving the platen towards the support means. The platen comprises a first set of fingers extending from the platen in the direction of the support means. Each finger in the first set includes a first and a second part. The first part engages the side surface of the carrier to move the carrier to a position wherein the second part of each finger is aligned with a different one of the second surface sections. This occurs during a first portion of the platen movement. The second part of each finger in the first set contacts a different one of the second surface sections and exerts a force thereon, in the direction of the support means, to cause the containers to be received within the respective container engaging openings. This occurs during a second portion of the movement of the platen.

A second set of fingers is provided. The fingers in the second set are aligned with the first surface and effective to exert a force thereon, in the direction of the support means, during the second portion of the movement of the platen.

The above-described structure not only automatically corrects any misalignment between the carrier and the containers and insures proper seating of each container within the aligned container engaging opening, but it accomplishes these functional results in a manner which minimizes damage to the carrier, the containers and the closures. This is achieved by positioning the fingers in the first set to align with points on the carrier (second surface sections) which are remote from the container engaging openings. Exerting forces on the carrier in this manner also reduces the amount of force which is required because it permits the container engaging projections to flex to the maximum extent, facilitating the insertion of the container within the openings.

In the fingers in the first set, the first part of the finger which engages the side surface of the carrier is the side or lower edge thereof. The second part of the finger, which exerts a force on the carrier in the direction of the carrier, is the bottom surface thereof, that is, the surface in face-to-face relation with the second surface section of the carrier.

The fingers of the first and second sets each preferably comprise a rigid base with a resilient tip. The resiliency of the tip serves to cushion the forces applied to the carrier to further reduce damage to the carrier.

Each of the fingers of the first and second sets preferably have a base which is substantially conically shaped. Because the incline of the base of the fingers of the first set is directed in the same general direction as the incline of the adjacent side surface of the carrier, cooperation between the first part of the fingers, in the first set and the inclined side surface on the carrier is enhanced to facilitate proper alignment of the carrier with respect to the containers.

The apparatus further includes means for retaining a stack of carriers, means for removing a carrier from the stack and means for depositing the removed carrier on a set of containers. The apparatus also comprises means for conveying a set of containers to the carrier depositing means and, thereafter, into alignment with the support means.

In one preferred embodiment, the fingers in the first set are longer than the fingers in the second set by a distance substantially equal to the distance between the level of the first surface and the level of the second surface sections of the carrier. In this embodiment, the bottom surface of the tips of the fingers of both sets contact the respective carrier surfaces substantially simultaneously such that the downwardly directed forces are applied to the various points on the carrier at approximately the same time.

In a second preferred embodiment, the fingers in the first set are longer than the fingers in the second set by a distance greater than the distance between the level of the first surface and the level of the second surface sections of the carrier. In this embodiment, the downwardly directed forces are applied to the periphery of the carrier slightly before the forces are applied to the center of the carrier to permit the body of the carrier to bow to a certain extent, as same is seated on the containers.

The number of fingers in the first set preferably equals the number of containers in the container set. Thus, if the carrier is being applied to a six-pack, six fingers are provided in the first set. If the carrier is being applied to an eight-pack, eight fingers are included in the first set.

The number of fingers in the second set is at least as great as the number of groups of four containers in the container set. Thus, if the carrier is being applied to a six-pack, at least one finger is provided for the second set. If the carrier is being applied to an eight-pack, at least two, and preferably three, fingers are included in the second set.

To the accomplishment of the above and to such other objects which may hereinafter appear, the present invention relates to a carrier applicator, as described in detail in the following specification and recited in the annexed claims, taken together with the accompanying drawings, wherein like numerals refer to like parts, and in which:

FIGS. 9A and 9B are front fragmentary views of a portion of a first preferred embodiment of the present invention, respectively at, and slightly after, contact between the first set of fingers and carrier; and, FIGS. 10A and 10B are front fragmentary views of a portion of the second preferred embodiment of the present invention, respectively at, and slightly after, contact between the first set of fingers and carrier.

Figure 1:
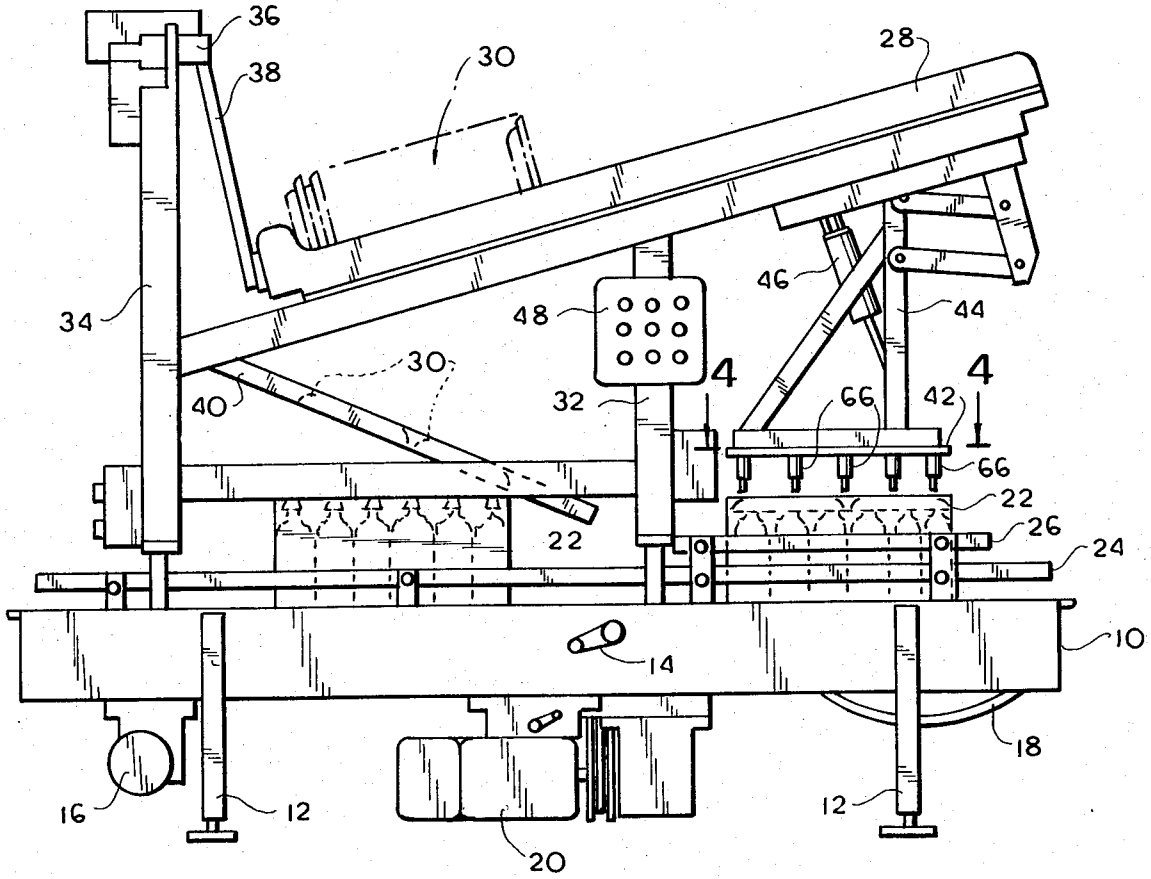
FIG. 1 is a side elevation view of the carrier applicator of the present invention.
Figure 2:
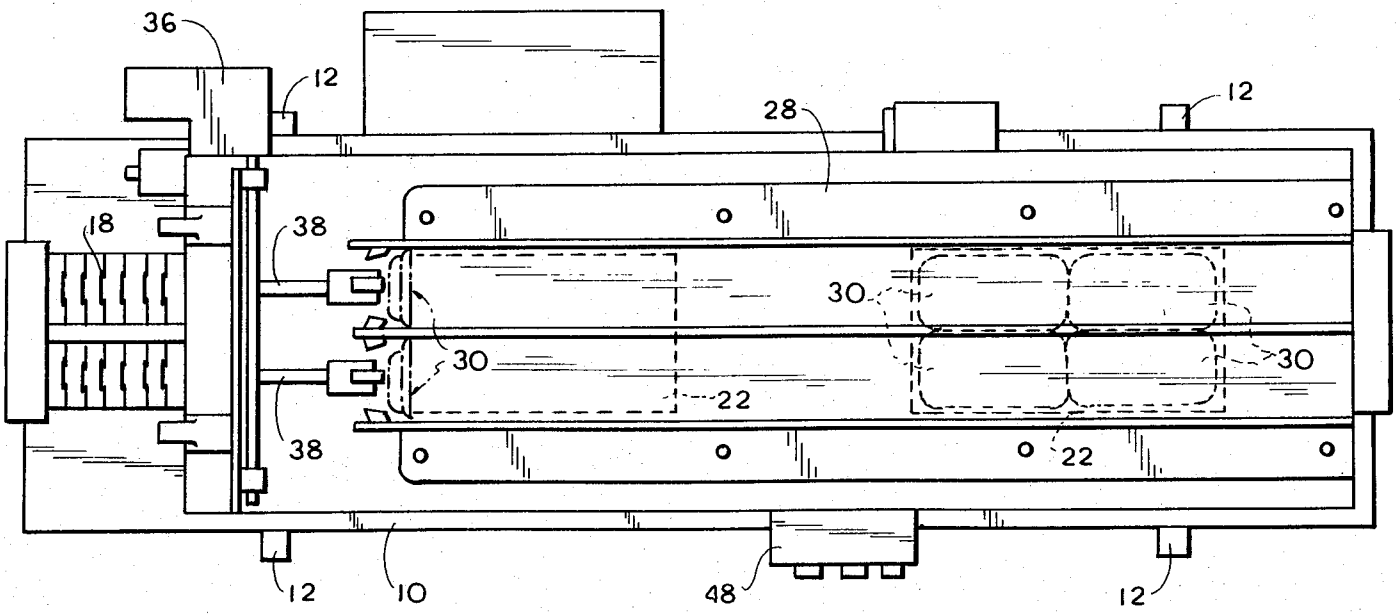
FIG. 2 is a top elevation view of the carrier applicator of the present invention.
Figure 3:
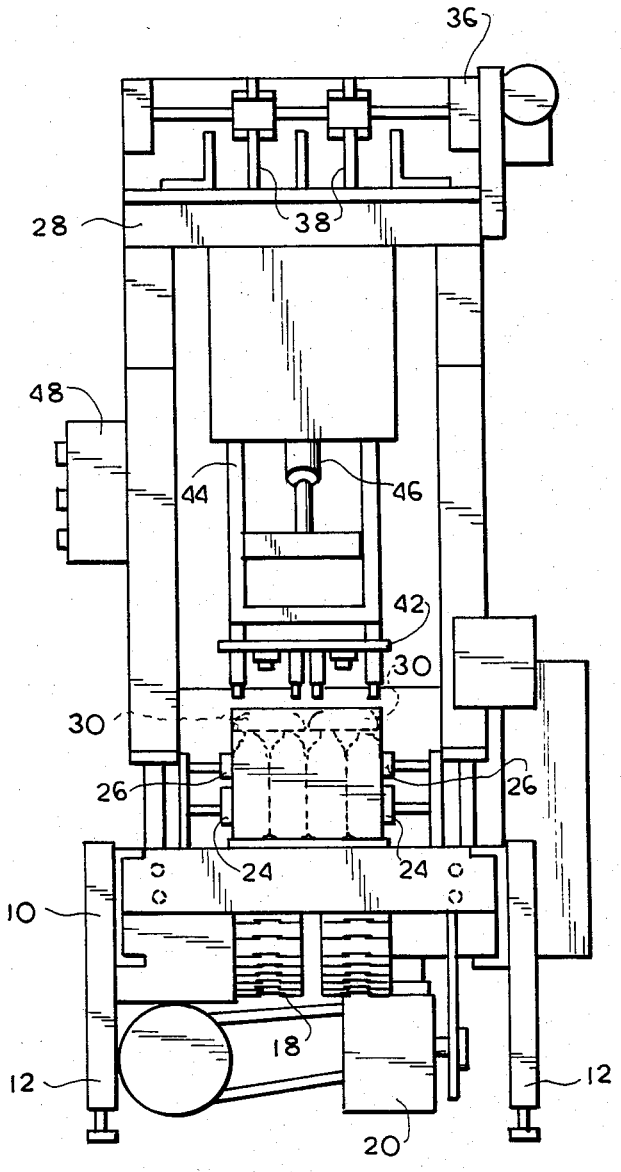
FIG. 3 is a front elevation view of the carrier applicator of the present invention.

As best seen in FIGS. 1, 2 and 3, the lower section of the carrier applicator of the present invention includes a table-like base 10, supported by four vertical legs 12. The effective length of legs 12 can be manually adjusted, in a conventional fashion, by the rotation of handle 14. An optional powered leg length adjustment motor 16 may also be provided. The adjustment of the effective length of legs 14 serves to raise or lower base 10 with respect to the floor upon which the apparatus rests.

Within base 10 is provided an endless belt-type case conveyor 18, powered by an electric motor 20. Conveyor 18 serves to transport cases 22, within which are situated sets of containers, from the input end (left, as seen in the drawings) to the output end (right, as seen in the drawings) of the carrier applicator.

The input end of the carrier applicator may be situated adjacent the output end of a case packer or other apparatus which supplies a flow of cases having containers therein. Of course, the cases can be loaded manually on the input end of the carrier applicator, if desired. However, the carrier applicator is normally used in conjunction with a case packer. Accordingly, the height of the case conveyor 18 is made adjustable to accommodate different case packers.

Case conveyor 18 is provided with guide rails 24 and 26 designed to maintain the proper lateral positioning of cases 22 with respect to conveyor 18, as the cases 22 are moved along the apparatus. Guide rails 24 and 26 extend above the surface of conveyor 18, on either side thereof.

Situated above case conveyor 18 is a hopper 28 upon which two side-by-side stacks of upstanding plastic carriers 30 are placed. Hopper 28 is positioned at an incline with respect to the horizontal to provide a gravity feed and is supported by vertical supports 32 and 34. Hopper 28 preferably has a capacity of 600 carriers which will last approximately five minutes at a speed of 30 cases per minute.

Mounted on top of vertical supports 34 is a carrier dispensing mechanism 36 which includes a pair of pivotal dispensing arms 38, one of which is aligned with each of the stacks on hopper 28. As arms 38 are pivoted, a carrier from the aligned stack on hopper 28 is permitted to drop, with the upper surface thereof facing upwardly, onto the aligned channel in a dual channel carrier depositing guide structure 40. As a case 22 is moved beneath guide 40 by conveyor 18, the first and second side-by-side pairs of carriers are deposited, in sequence, onto the first and second side-by-side sets of containers in case 22.

As illustrated in the drawings, each case 22 contains twenty-four containers, shown here as bottles, such that four carriers will be deposited in each case, thereby forming four six-packs per case. The movement of case 22 along conveyor 18 is synchronized with the release of the carriers from carrier guide 40, such that each carrier will be deposited on the tops of the closures of the six bottles to which it will be applied.

After carriers 30 have been deposited on the containers within case 22, case conveyor 18 conveys case 22 towards the output end of the apparatus until the case 22 is at a point on the apparatus above the rear legs 12. Once in this position, the motion of the case is temporarily stopped by the inertia of a lever arm (not shown) which intersects the path of the case and interferes with the movement of the case as it is cammed out of the way by the case. Above this point on conveyor 18 is a platen 42 having a structure described in detail below.

Platen 42 is supported from above by a mechanical linkage 44 which, in turn, is suspended from the underside of hopper 28. Linkage 44 is a well known parallelogram-type linkage which permits platen 42 to be reciprocated vertically while maintaining a horizontal position with respect to the surface of conveyor 18. Linkage 44 is driven by a pneumatic cylinder 46 connected between linkage 44 and the under-surface of hopper 28.

When case 22 is sensed (with any conventional sensor, such as a photo-electric sensor) to be in the correct position with respect to platen 42, penumatic cylinder 46 is actuated to move platen 42 towards the surface of conveyor 18. This movement, in general, causes platen 42 to apply a downwardly directed force on the four carriers 30 in case 22 so as to seat same simultaneously on the four sets of containers in the case. After the downward stroke of platen 42 is completed, cylinder 46 automatically reverses direction, causing platen 42 to move upwardly, thereby withdrawing it from case 22. Once platen 42 has cleared case 22, the case is accelerated up to the normal speed by conveyor 18 so as to move the case, now containing the container sets with the carriers seated thereon, to the output end of the apparatus to permit removal of same. At the same time, the next case 22 in succession is moved into position in alignment with the platen 42 and the carrier applying cycle is repeated.

In this manner, carriers are applied, four at a time, to four sets of containers in each case, in a high-speed automated operation. The operator is provided with a set of controls on control box 48 such that the operation of the apparatus can be conveniently controlled.

Figure 4:
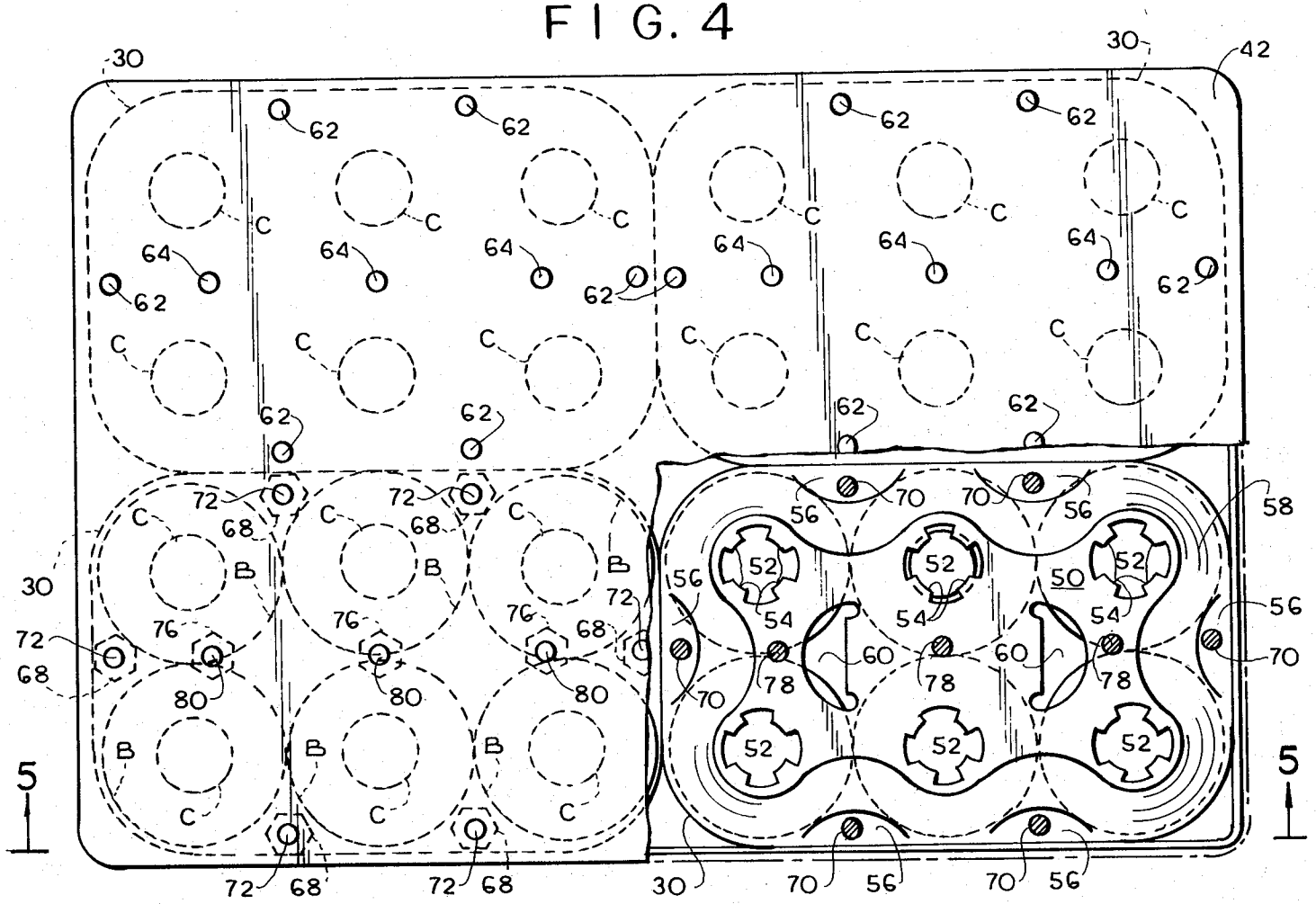
FIG. 4 is a top, partially cut away, view of the platen of the carrier applicator of the present invention, taken along line 4—4 of FIG. 1.

The structure of platen 42 can best be appreciated with reference to FIG. 4. Platen 42 has a substantially planar lower surface which can be conceptually divided into four quadrants. Each quadrant aligns with and serves to seat a different one of the carriers 30. Each carrier 30 is applied to a set of containers, illustrated as bottles B. In the drawings, each set of bottles B is illustrated as including six bottles in a two-by-three array. However, it is to be understood that with slight modifications, well within the skill of the ordinary artisan, sets of bottles B containing eight bottles in a two-by-four array can be easily accommodated. Each bottle B has a closure C on the top thereof.

The structure of the carrier 30 is best illustrated in FIGS. 4–8. Carrier 30 comprises a substantially planar upper surface 50 having six spaced bottle engaging openings 52, each having a plurality of diametrically opposed, inwardly extending, flexible bottle engaging projections 54. Upper surface 50 of carrier 30 defines the top of the compartments into which bottles B will be received. The peripheral edge of surface 50 follows the contours of the compartments into which the bottles will be received.

At a level below the level of upper surface 50 are located a plurality (in this case six) second surface sections 56 which are distributed around the periphery of the carrier. Second surface sections 56 are substantially co-planar and have a curved inner edge following the contours of the container receiving compartments and a substantially straight outer edge parallel to the skirt of the carrier. Two surface sections 56 are provided on each side of the carrier and one is provided on each end of the carrier. Between upper surface 50 and lower surface sections 56 is an at least partially inclined side surface 58 which extends continuously around the carrier and defines the side portions of the compartments into which the bottles B will be received. The upper surface 50 is preferably provided with a pair of spaced finger-grip openings 60, shown here as substantially semi-circular openings. Openings 60 provide a means for grasping the carrier between the thumb and forefinger.

Each quadrant of platen 42 is provided with six bores or openings 62, each of which aligns with a different one of the lower surface sections 56 on carrier 30. In the central portion of each quadrant are located three bores or openings 64 which align with different points along the upper surface 50 of carrier 30.

Figure 5:
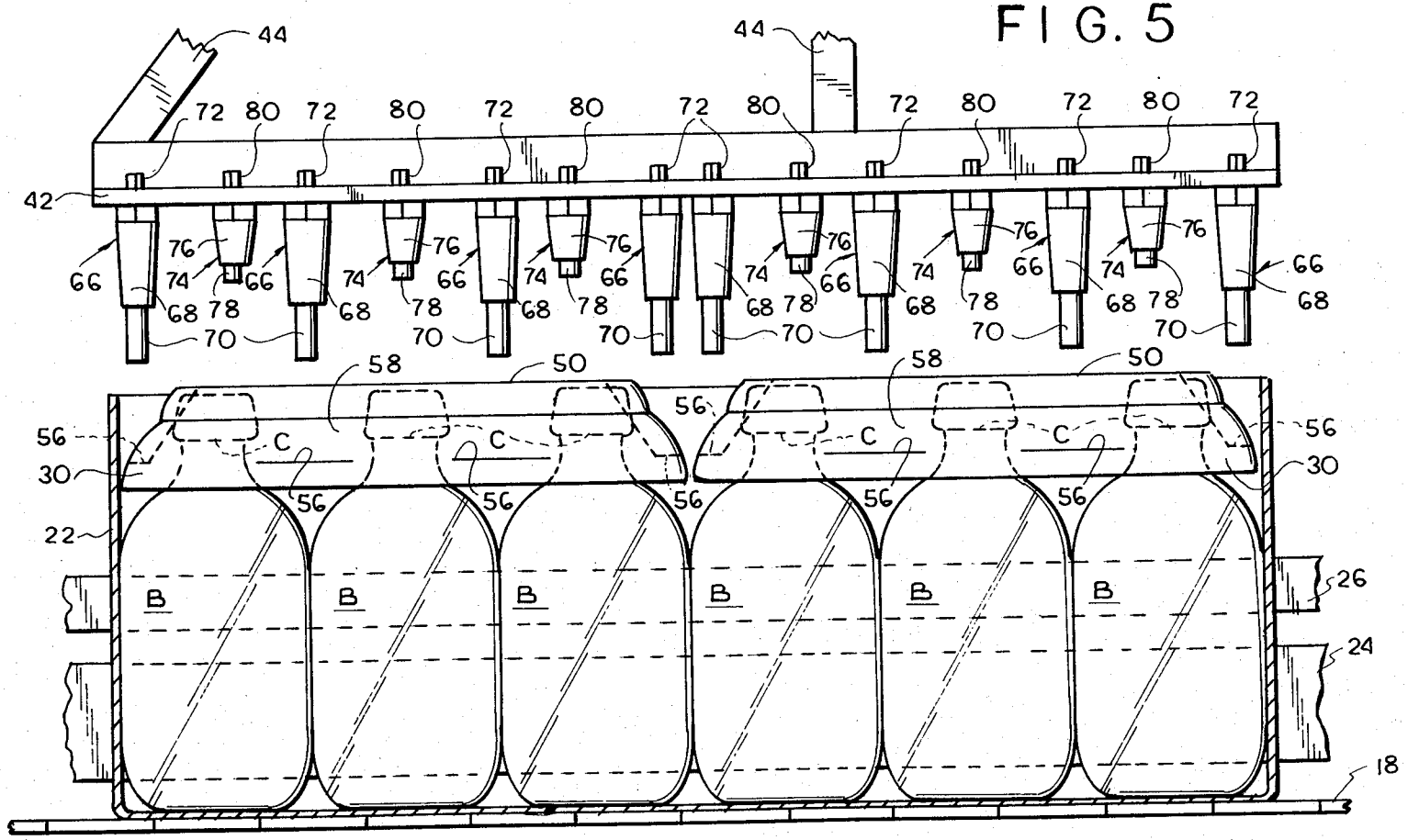
FIG. 5 is a side elevation view of a portion of the carrier applicator of the present invention showing the details of the platen and the position thereof just prior to contact with the carriers.

The lower surface of platen 42 has four groups of fingers extending therefrom. Each group of fingers extends from a different quadrant of the platen. Each group of fingers comprises a set of long fingers 66 and a set of short fingers 74. As best seen in FIG. 5, long fingers 66 each comprise a rigid base 68 and a resilient tip 70. Extending from rigid base 68 is a post 72 designed to be inserted through an aperture 62 on platen 42 and to be secured thereto by adhesive or the like.

Short fingers 74 comprise a rigid base 76 and a resilient tip 78. Extending upwardly from base 76 through aperture 64 in platen 42 are posts 80 which are affixed to the platen. At least one short finger 74 and as many as three are provided for each quadrant of the platen 42.

In the first preferred embodiment of the present invention, the difference in the effective length between long fingers 66 and short fingers 74 is substantially equal to the vertical distance between the level of upper surface 50 and the level of coplanar lower surface sections 56 on carrier 30. This is illustrated in FIGS. 9A and 9B. FIG. 9A shows that the tip 70 of finger 66 contacts section 56 at about the same time that tip 78 of finger 74 contacts surface 50. Forces are exerted on sections 56 and surface 50 at approximately the same time, resulting in a slight distortion of the carrier from its original shape as the closure C is received within opening 52, as illustrated in FIG. 9B. With long and short fingers of this relative configuration, all of the downwardly directed forces applied to the carrier will be applied substantially simultaneously.

In the second preferred embodiment of the present invention, as illustrated in FIGS. 10A and 10B, the difference between the effective length of long fingers 66 and short fingers 74' is slightly greater than the distance between the level of upper surface 50 and the level of the lower sections 56 of carrier 30. In this embodiment, the downwardly directed forces on lower surface sections 56 are applied slightly before the forces on upper surface 50 are applied, as illustrated in FIG. 10A. With this relative configuration, an upward concave bowing of the carrier surface 50 results immediately after fingers 66 contact surfaces 56, as illustrated in FIG. 10B. This bowing or flexing facilitates the initial insertion of the closures C through the container engaging openings 52.

Figure 6:
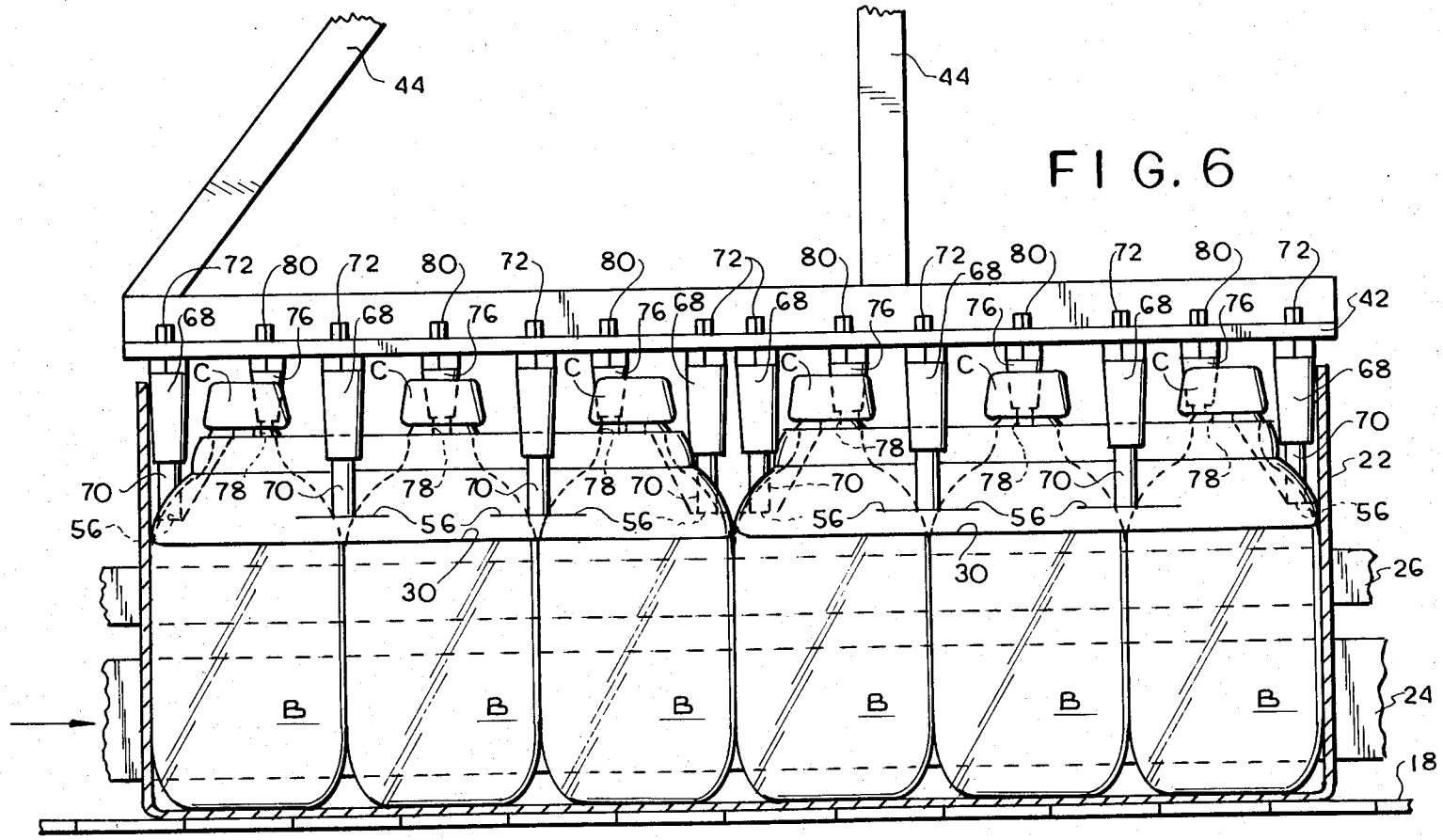
FIG. 6 is a side elevation view of the portion of the carrier applicator of the present invention illustrated in FIG. 5, showing the platen at the end of its downward movement.
Figure 7:
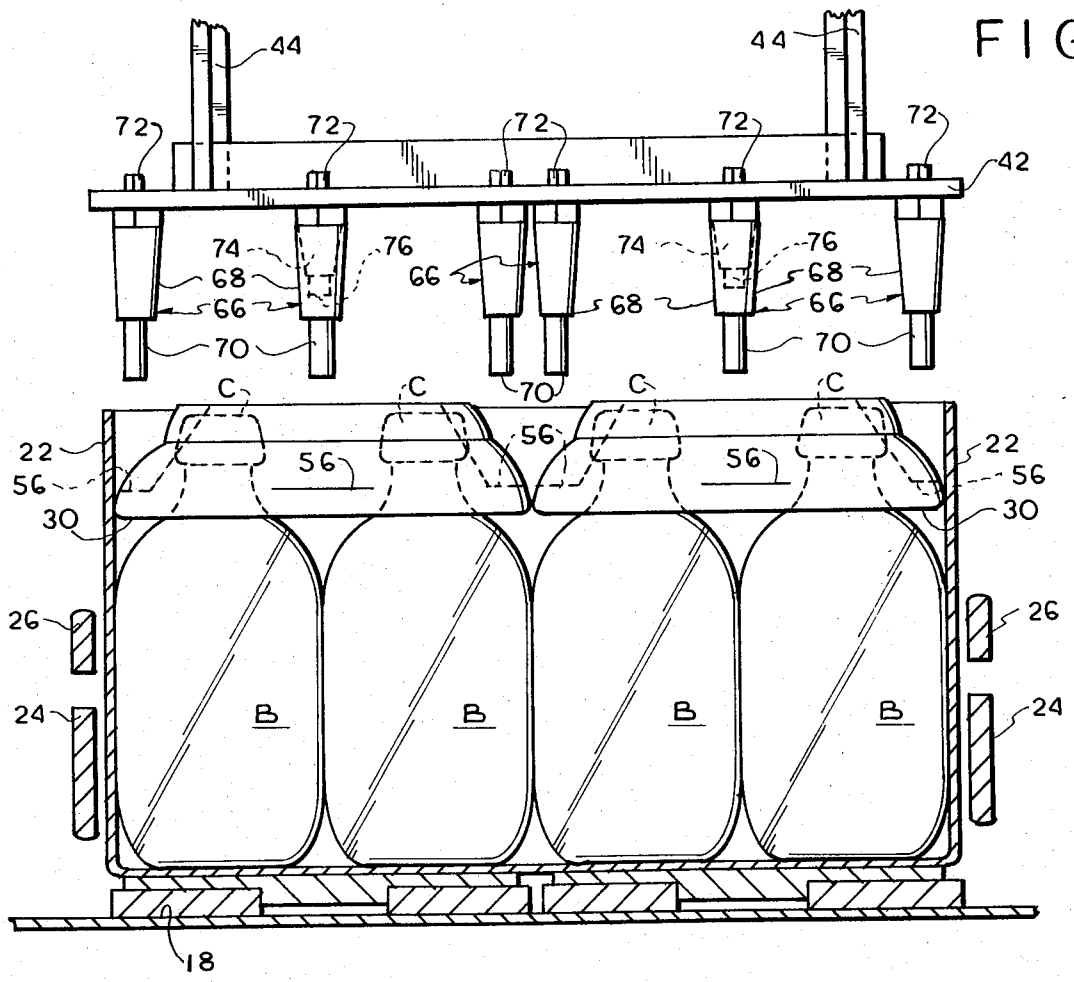
FIG. 7 is a front elevation view of the portion of the carrier applicator of the present invention illustrated in FIG. 5.
Figure 8:
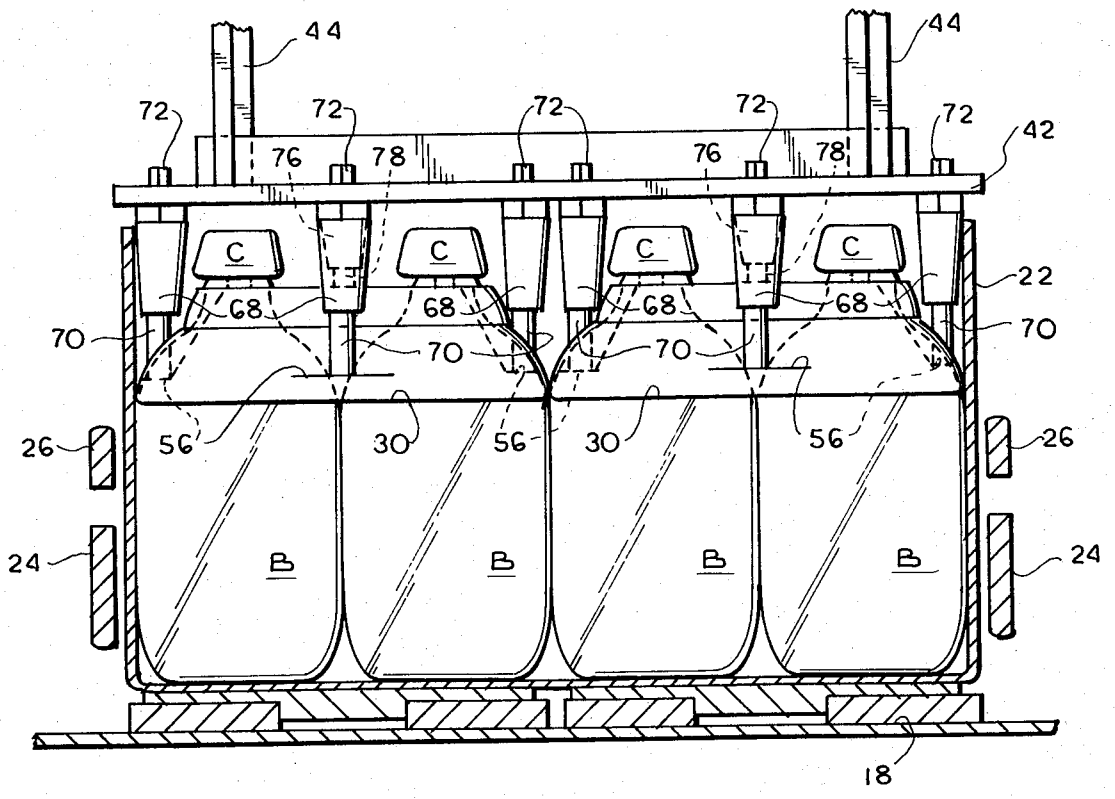
FIG. 8 is a front elevation view of the portion of the carrier applicator of the present invention illustrated in FIG. 6.

The arrangement of long fingers 68 and short fingers 74 relative to the various portions of carrier 30 is important to the proper functioning of the platen. FIGS. 5 and 7 are, respectively, side and front views showing platen 42 at the highest point in its vertical travel path, remote from carriers 30. FIGS. 6 and 8, respectively, are side and front views showing platen 42 at the lowest point in its vertical travel path where carriers 30 have been seated on bottles B in case 22.

From these figures, it can be seen that fingers 68 are arranged to align with points on the carrier which surround the side surface 58 of the carrier. Thus, misalignment can be corrected from any of four different directions. This arrangement will assure contact with the appropriate portion of side surface 58, if the carrier is misaligned, regardless of the direction of misalignment. The misalignment is, thus, always corrected. This eliminates the possibility of any downwardly forces being applied by the platen to a misaligned carrier, the result of which might be a damaged carrier or damaged closures which would require a temporary stoppage of the apparatus such that the damaged objects could be removed.

As can best be seen from FIG. 4, openings 62, which determine the placement of long fingers 66, are distributed around the periphery of each quandrant of platen 42 in alignment with the lower surface sections 56 of the carrier. As the platen is lowered towards the carrier, if the carrier is not properly aligned with the bottles, the side surface or lower edge of the long fingers 66 will contact the carrier side surface 58, which is in the path of the downwardly moving finger 66 due to carrier misalignment and cause the carrier 30 to move parallel to the platen (see FIG. 10A) to a position wherein side surface 58 is positioned between the fingers 66. Thus, as platen 42 is moved downwardly, long fingers 66 cooperate with side surface 58 to insure the proper alignment of carrier 30 with respect to the bottles. By the time the bottom surface of the tips of fingers 66 contact lower surface sections 56 at respective points therein immediately adjacent side surface 58, any misalignment of the carrier 30 with respect to bottles B has been corrected. Thus, the closure C of each bottle is now properly aligned with the respective bottle engaging opening 52. This being the case, any possible damage to the carrier or to the closures is minimized, if not eliminated.

It is also important to note that fingers 66 and 74 are positioned on platen 42 such that they contact points on carrier 30 which are remote from the bottle engaging openings 52. Thus, under normal conditions, it is highly unlikely that the platen 42 or the fingers 66 and 74 extending therefrom will come in contact with any of the closures. In this manner, damage to the closure or the bottle is further minimized.

It should also be appreciated that the amount of force required to seat the carrier is reduced by positioning fingers 66 and 74 in the manner previously described. By exerting the downward forces on lower surface sections 56 and at points on upper surface 50 remote from the bottle engaging openings 52, instead of near or directly on the inwardly extending bottle engaging projections 54, the projections are permitted to flex to the maximum extent as the bottle neck is received. This reduces the amount of downward force required to properly seat the carrier.

This should be contrasted with the techniques used in the prior art carrier applying equipment wherein it was believed that the downwardly directed forces should be exerted directly on or immediately adjacent to the bottle engaging projections to insure proper seating. It has now been determined that by correctly distributing and applying the downwardly directed forces at points remote from the bottle engaging openings, the inwardly extending projections 54 are permitted to flex to a greater extent, thereby facilitating the seating of the carrier.

In the first preferred embodiment, where the difference in length between fingers 66 and 74 is equal to the distance between upper surface 50 and lower surface sections 56, all of the fingers contact the carrier at substantially the same point in time. Thus, the downwardly directed forces on the carrier are distributed relatively uniformly across the carrier and upward concave bowing of the carrier surface 50 is minimized. However, in the second preferred embodiment, the distance between long fingers 66 and short fingers 74' is slightly greater than the distance between upper surface 50 and lower surface sections 56 on carrier 30 such that the long fingers 66 will contact lower surface sections 56 at a point in time slightly ahead of the contact between the short fingers and upper surface 50. In this case, surface 50 of the carrier will assume a slightly concave condition as the downwardly directed forces are applied to surface sections 56. In certain instances, this may facilitate the proper seating of the carrier.

While the structure of platen 42 has been described and illustrated as designed for use for applying carriers to six-packs containing a two-by-three array of bottles, it should be appreciated that with slight modifications, well within the skill of the ordinary artisan, the platen can be modified for use in applying carriers to any number of bottles, for example, an array of two-by-four bottles. In this instance, eight long fingers 66 would be utilized—one for each of the eight surface sections 56 present on the carrier. Preferably, the number of long fingers utilized equals the number of containers in the container set. However, the number of short fingers utilized can vary, depending upon the application. Although the present invention has been described with three short fingers 74 extending from each quadrant of platen 42, the number of short fingers may vary in accordance with the particular application. Normally, at least one short finger is required. However, the number of short fingers should preferably be at least as great as the number of groups of four containers in the container set. Thus, when the carrier is used to contain a six-pack, at least one short finger is required. When the carrier is used to contain an eight-pack, at least two short fingers are required. However, three short fingers can be used to more evenly distribute the downwardly directed forces across upper surface 50 of the carrier.

It will now be appreciated that the present invention relates to a carrier applicator designed for fully automatic, high-speed operation which insures proper seating of the carriers in each instance. Moreover, the structure and positioning of the fingers extending from the platen, and the manner in which same cooperate with the side surface of the carrier, insures that each carrier will be automatically properly aligned with respect to the containers during the application operation. The fingers are positioned with respect to the carrier such that the downwardly exerted forces on the carrier are exerted at points which are remote from the container engaging openings. This, and particularly the application of the forces on the lower surface sections, reduces the amount of downwardly force necessary to properly seat the carrier by permitting maximum flexing of the container engaging projections. All of these factors result in the minimization of any possibility of damage to the carriers, the closures, or the bottles during the application operation.

While only a limited number of preferred embodiments of the present invention have been disclosed herein for purposes of illustration, it is obvious that many modifications and variations could be made thereto. It is intended to cover all of these variations and modifications which fall within the scope of the present invention, as defined by the following claims:

I claim:

1. Apparatus for applying a carrier to a set of containers, the carrier being of the type having a substantially planar first surface with spaced container engaging openings therein, a plurality of second surface sections, located at a level spaced from the first surface and an at least partially inclined side surface extending between the first surface and each of the second surface sections, said apparatus comprising a platen, means for supporting a set of containers with a carrier situated thereon and means for moving said platen towards said support means, said platen comprising a first set of fingers extending from said platen in the direction of said support means, said fingers of said first set being effective, if said platen and the carrier are not properly aligned, to cooperate with the side surface of the carrier, as said platen moves towards said support means to move the carrier to a position wherein each of said fingers in said first set aligns with and contacts a different one of the second surface sections, said platen further comprising a second set of fingers, said fingers in said second set being adapted to align with and contact said first surface at different points thereon remote from the container engaging openings, said fingers in said first and said second sets each exerting a force, in the direction of said support means, on the respective surfaces with which same are aligned, to cause the containers to be received within the respective container engaging openings, as the platen moves towards said support means.

2. The apparatus of claim 1, wherein said fingers of said first and second sets each comprise a rigid base with a resilient tip.

3. The apparatus of claim 1, wherein said fingers of said first and second sets are substantially conically shaped.

4. The apparatus of claim 1, further comprising means for retaining a stack of carriers, means for removing a carrier from said stack, and means for depositing said removed carrier on a set of containers.

5. The apparatus of claim 4, further comprising means for conveying a container set to said carrier depositing means and, thereafter, into alignment with said support means.

6. The apparatus of claim 1, wherein the location of the tips of said fingers in said first set, relative to the tips of said fingers in said second set, is substantially equal to the distance between the level of said first surface and the level of said second surface sections.

7. The apparatus of claim 1, wherein the location of the tips of said fingers in said first set, relative to the tips of said fingers in said second set, is greater than the distance between the level of said first surface and the level of said second surface sections.

8. The apparatus of claim 1, wherein the number of fingers in said first set equals the number of containers in the container set.

9. The apparatus of claim 1, wherein said platen comprises means for applying multiple carriers to multiple container sets simultaneously.

10. Apparatus for applying a carrier to a set of containers, the carrier being of the type having a substantially planar first surface with spaced container engaging openings therein, a plurality of substantially coplanar second surface sections situated near the periphery of the carrier, at a level spaced from the level of said first surface, and an at least partially inclined side surface extending between said first surface and said second surface sections, said apparatus comprising a platen having first and second sets of fingers extending therefrom in the direction of the carrier, said fingers of said first set being positioned to align with different ones of said second surface sections, respectively, said fingers of said second set being positioned to align with different points on said first surface remote from said container engaging openings, means for supporting a set of containers, with a carrier situated thereon, and means for moving said platen relative to said support to cause said fingers in said first set to engage and cooperate with said inclined side surface, to correct any carrier misalignment relative to the containers and, thereafter, to engage said second surface sections, respectively, and to cause said fingers in said second set to engage said points on said first surface, such that forces applied to the carrier by said fingers in said first and said second sets causes the containers to be received in and engaged by the openings aligned therewith.

11. The apparatus of claim 10, wherein said fingers of said first set are of a different length than said fingers of said second set.

12. The apparatus of claim 10, wherein said fingers of said first set are longer than said fingers of said second set.

13. The apparatus of claim 10, wherein the location of the tips of said fingers in said first set, relative to the tips of said fingers in said second set, is greater than the distance between the level of said first surface and the level of said second surface sections.

14. The apparatus of claim 10, wherein the number of fingers in said first set equals the number of containers in the container set.

15. The apparatus of claim 1 wherein said first set of fingers comprises at least four spaced fingers, each of which is positioned to engage said side surface from a different one of four directions.

16. The apparatus of claim 1 wherein the sets of containers each include a given number of sets of four containers and wherein the number of fingers in said second set of fingers is at least as great as said given number.

* * * * *